US005613617A

United States Patent [19]

Da Vitoria Lobo

[11] Patent Number: 5,613,617

[45] Date of Patent: Mar. 25, 1997

[54] SEALED CONTAINER THAT IS EASILY OPENED AND MASS-PRODUCED

[76] Inventor: Luis J. Da Vitoria Lobo, Box 2086, Manuels, NF., Canada, A1W 1C9

[21] Appl. No.: 313,329

[22] Filed: Sep. 27, 1994

[51] Int. Cl.[6] ..... B65D 41/00

[52] U.S. Cl. ..... 220/359; 215/232

[58] Field of Search ..... 220/270, 276, 220/359, 287; 215/232, 256, 349; 229/125.35

[56] References Cited

U.S. PATENT DOCUMENTS

| | | | |
|---|---|---|---|
| 1,441,712 | 1/1923 | Picard | 220/287 |
| 3,443,741 | 5/1969 | Stockdale | 229/125.35 X |
| 3,660,960 | 5/1972 | Inman | 229/125.35 X |
| 4,209,126 | 6/1980 | Elias | 220/359 X |
| 4,210,674 | 7/1980 | Mitchell | 229/125.35 X |
| 5,062,569 | 11/1991 | Hekal | 229/125.35 X |
| 5,316,603 | 5/1994 | Akazawa et al. | 220/359 X |

FOREIGN PATENT DOCUMENTS

| | | | |
|---|---|---|---|
| 0398316 | 11/1990 | European Pat. Off. | 220/359 |
| 0549965 | 7/1993 | European Pat. Off. | 220/359 |
| 0212381 | 9/1991 | Japan | 220/359 |
| 3289467 | 12/1991 | Japan | 220/359 |
| 6024467 | 2/1994 | Japan | 220/359 |

*Primary Examiner*—Stephen K. Cronin

[57] ABSTRACT

A sealed container with lip and bonded covering, having a circular top, is disclosed. A tab is provided for, within the limitations of a circular top, which allows the seal to be easily opened by hand. For example, the circular cut may be positioned so as to extend to one side of the container more than it does on the opposite side so that the tab is created from a portion of the covering on the extending side.

5 Claims, 1 Drawing Sheet

SEALED CONTAINER THAT IS EASILY OPENED AND MASS-PRODUCED

BACKGROUND OF THE INVENTION i) Technical Field

This invention relates to a sealed container for packaging, comprising a main container body with a lip or flange and a flexible top or covering that is sealed or bonded to the lip, wherein the top can be peeled to open the seal.

ii) Background Art

One method of mass-producing packaging containers is to form a number of container bodies at one time by making a number of shaped depressions in a single sheet of suitable material, usually of plastic or metal. The depressions may then be charged with the material to be packaged. A covering sheet or film is then bonded to this formed sheet with the shaped depressions. The covering might have its own shaped depressions, and could include printing on its surface. This bonding step results in a number of sealed containers, all joined together, because they were fabricated from one underlying sheet. This is followed by a die-cutting operation that separates the individual sealed containers, each having a lip and a tab, or a means to create a tab, that allows for manual opening of the seal and removal of the cover of the container.

In the past art, this tab has been provided for by a generally V-shaped portion that has extended from the lip of the container. To provide for this tab, the separation of the containers has required a die-cutting operation with non-circular dies. Among other problems, non-circular dies have higher fabrication and maintenance costs than comparable circular dies. Furthermore, a non-circular cut cannot be easily made with a rotating cutter.

The operation that separates the individual sealed containers could be sped up and improved if the die-cutting operation, using non-circular dies, was replaced by a cutting operation that produced a circular top on each container. Such a circular top could then be produced by a suitable rotating cutter or a circular die.

SUMMARY OF THE INVENTION

It is an object of this invention to benefit by using circular cuts to separate the individual sealed containers, while providing for a tab for each container, within the limitations of a circular top, that allows the seal to be easily opened.

BRIEF DESCRIPTION OF THE DRAWINGS

In drawings which illustrate embodiments of the present invention.

DESCRIPTION OF THE PREFERRED EMBODIMENTS

Figure 2:
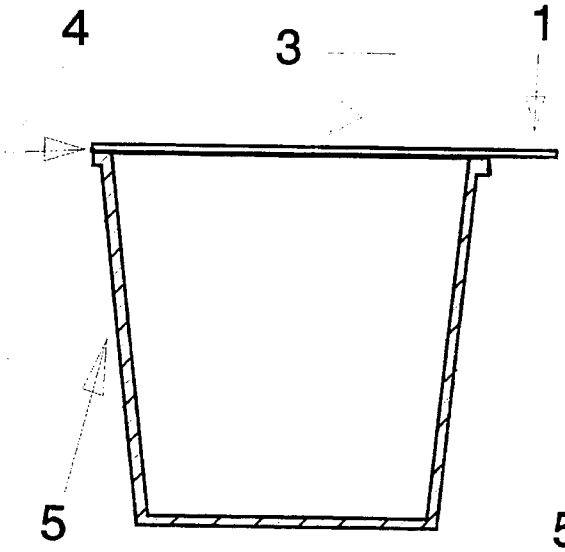
FIG. 2 is the sectional view from the front of the embodiment shown in FIG. 1.
Figure 4:
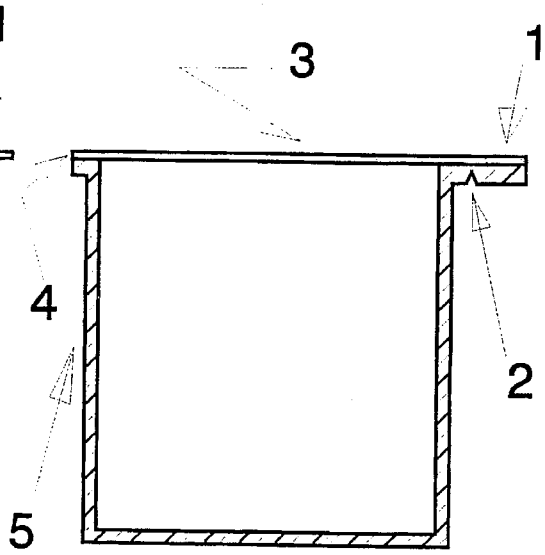
FIG. 4 is the front sectional view of the embodiment shown in FIG. 3.

In FIGS. 2 and 4 showing cross-sections of the embodiments, the material of the container body is shown, by cross-hatching, to be made of plastic, simply because the present art generally employs polymeric materials for many container bodies. However, metals are often used and other classes of materials could be used. It is not the intention of this disclosure to restrict the invention to plastic materials for the body of the container. Furthermore, a suitable rotary cutting operation, that can be used to produce a circular top, can provide further advantages for some of these materials.

Figure 1:
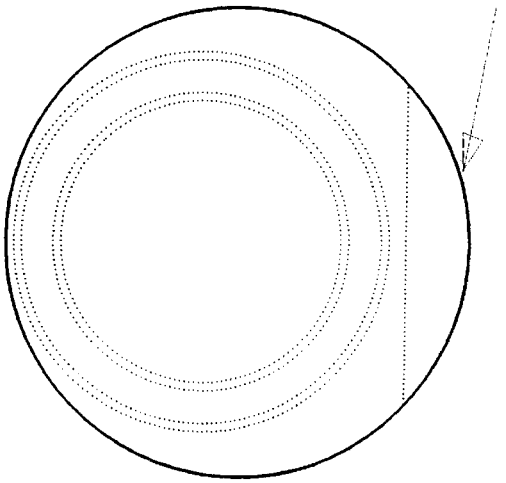
FIG. 1 is the top or plan view of one embodiment of the invention.

In FIG. 1 the shape of the depression that forms the body of the container is a cylinder with a small taper. The axis of the circular cut that forms the container's top is displaced from the axis of the tapered cylinder. The portion of the circular covering that forms the tab 1 is shown.

In FIG. 2, the cross-section of the body of the container 5 with an outward extending lip or flange is seen, with the covering 3 and the bonding 4 that seals the covering to the lip of the container. The covering may be made of flexible material. The tab 1, seen from the front, is formed by the portion of the overhanging material of the covering after the material from the lip of the container adjacent to this portion has been removed.

Figure 3:
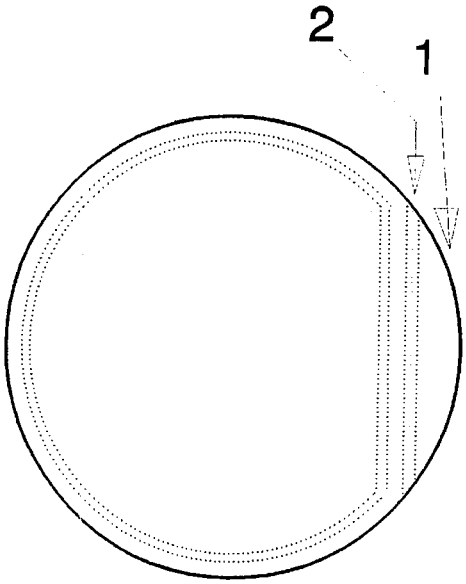
FIG. 3 is a plan view of a second embodiment of this invention.

FIG. 3 is another embodiment of the invention. The shape of the depression that forms the body of the container below the lip is a partial or truncated cylinder, when viewed from above, with a circular top covering. In this embodiment, a means to create a tab located at 1 with a notch 2 is shown.

In FIG. 4, the bond 4 between the lip of the container and the covering 3 is shown. The means to create the tab is seen here from the front. The tab is formed by snapping off the portion of the lip of the container at the notch 2. The portion of the lip to the right of the notch 2 may or may not be bonded to the covering 3. The covering can then be removed by pulling upwards on the tab 1.

Thus this invention encompasses a wide range of sealed container configurations and includes, but is not limited to, the specific descriptions employed here to describe the invention.

In the Claims, the "tab" means a part of the sealed container that can be secured and pulled to break the seal and separate the covering from the container.

I claim:

1. A sealed container comprising a container body part with a surrounding outward extending lip and a circular covering part that is bonded to at least a portion of said lip, further including a tab, or a means to create a tab, from within a portion of said circular covering part.

2. The invention defined in claim 1 wherein said lip does not extend adjacent to said tab.

3. The invention defined in claim 2, further including a notch on said lip which affords said means to create a tab, wherein said container body part is on one side of said notch and a portion of said circular covering part and the portion of said lip that is located adjacent to said portion of said circular covering part are on the other side of said notch.

4. The invention defined in claim 3 wherein said portion of said circular covering part is bonded to said adjacent portion of said lip.

5. The inventions defined in claims 1, 2, 3 or 4 wherein said container body part is symmetrical about an axis of rotation and where said axis is displaced from the axis of rotation of said circular covering part.

* * * * *